United States Patent [19]

Sato et al.

[11] Patent Number: 5,027,731

[45] Date of Patent: Jul. 2, 1991

[54] THREAD CUTTING KNIFE DEVICE IN A SEWING MACHINE

[75] Inventors: Shuichi Sato; Yoshimi Koguchi, both of Tochigi, Japan

[73] Assignee: SSMC Inc., Edison, N.J.

[21] Appl. No.: 425,256

[22] Filed: Oct. 23, 1989

[30] Foreign Application Priority Data

Apr. 11, 1988 [JP] Japan ..... 63-143438[U]

[51] Int. Cl.[5] ..... D05B 65/00

[52] U.S. Cl. ..... 112/286; 112/289; 112/291; 112/292

[58] Field of Search ..... 112/286, 289, 291, 292, 112/300

[56] References Cited

U.S. PATENT DOCUMENTS

| | | | |
|---|---|---|---|
| 3,512,491 | 5/1970 | Heimann et al. | 112/292 |
| 3,728,978 | 4/1973 | Honda et al. | 112/292 |
| 3,921,554 | 11/1975 | Uozaki et al. | 112/292 |
| 4,437,423 | 3/1984 | Yamazawa | 112/292 |

FOREIGN PATENT DOCUMENTS

| | | | |
|---|---|---|---|
| 1417320 | 12/1975 | United Kingdom | 112/291 |

*Primary Examiner*—Werner H. Schroeder
*Assistant Examiner*—Paul C. Lewis
*Attorney, Agent, or Firm*—Theodore Jay

[57] ABSTRACT

A thread cutting knife device in a sewing machine having a bed has a lower shaft rotatably supported at the bed and a throat plate mounted thereon. A hook is attached to the lower shaft and extends beyond a throat plate. A thread cutting knife and a loop spreading plate are adapted to cross between the hook and the throat plate to cut a needle thread looping portion at a cloth side and a bobbin thread. The knife and the plate are respectively rotatably supported by the lower shaft. The knife has a blade at an upper edge of the tip end thereof. The loop spreading plate has a thread dividing portion extending into the needle thread looping portion at the cloth side and a thread looping portion at the side of the needle. A thread drawing portion is formed at one edge of a base of the dividing portion for holding the needle thread looping portion at the cloth side and the bobbin thread. A blade positioned at the side of the throat plate and is opposed to and crosses the blade of the thread cutting knife.

2 Claims, 4 Drawing Sheets

THREAD CUTTING KNIFE DEVICE IN A SEWING MACHINE

BACKGROUND OF THE INVENTION

1. Field of the Invention

The present invention relates to a thread cutting knife device disposed under a bed of a sewing machine.

2. Description of the Prior Art

A thread cutting knife device known in the prior art is disposed in a thread cutting unit of a sewing machine. The thread cutting unit is used for cutting a stitching thread and consists of a needle thread looping portion at the side of a cloth and a bobbin thread which is located under the sewn cloth, namely, between a throat plate on which a sewn cloth is placed and a hook. The hook cooperates with a needle as it moves from the surface of the sewn cloth to an upper stop position raised above the surface of the sewn cloth. The sewing machine provided with this type of unit is called a thread cutting sewing machine.

When prior art thread cutting units are used, it is desirable to cut off the needle thread looping portion and the bobbin thread under a portion as close as possible to the throat plate while keeping the needle thread and the bobbin thread held properly on the side of the sewing machine for forming an appropriate stitch from the first stitch at the next sewing operation after completion of sewing operation. When the cutting of the needle thread and the bobbin thread takes place at the portion as close as possible to the throat plate, thread ends remaining on the needle thread and the bobbin thread will be shortened so that it is not necessary to employ an additional process to remove the thread ends in order to improve the working efficiency. However, the thread ends of the needle thread and the bobbin thread remaining on the sewn cloth after completion of the sewing operation must be cut off by a sharp blade to insure the quality of the sewn cloth.

However, it is difficult to separate the needle thread looping portion at the side of the cloth and the bobbin thread from the needle thread looping portion at the side of the needle in order to cut off the needle thread and the bobbin thread at the ideal position close to the sewn cloth. Furthermore, the blade of the thread cutting knife and the needle thread and the bobbin thread are brought into extremely close contact with each other whereby long ends of the needle thread, and the bobbin thread remain on the sewn cloth. Consequently, the sewn cloth can be damaged by the blade of the thread cutting knife whereby the appearance of the sewn cloth deteriorates.

For example, the thread cutting unit of the sewing machine disclosed in Japanese Patent Publication No. 57-54158 comprises a thread cutting knife movable along an outer periphery of a hook and a loop spreading plate. The thread cutting knife has a flat plate shape and is disposed over the loop spreading plate having a flat plate shape so that the needle thread looping portion at the side of the cloth and the bobbin thread are separated from the needle thread looping portion at the side of the needle by a forked catch portion and caught thereby, whereby the blade at the tip end of the thread cutting knife crosses the catch portion at the tip of the loop spreading plate to thereby cut off the stitching thread in a tension state. As a result, the portion cut off by the blade is not stable and the needle thread and the bobbin thread can be damaged by the blade. Furthermore, the separation of the loop spreading plate at the side of the cloth and the bobbin thread from the loop spreading plate at the side of the needle is incompatible with the reduction of length of thread ends remaining on the loop spreading plate at the side of the cloth and the bobbin thread.

SUMMARY OF THE INVENTION

It is therefore a first object of the present invention to provide a thread cutting knife device capable of separating the needle thread looping portion at the side of the cloth and the bobbin thread from the needle thread looping portion at the side of the needle.

It is a second object of the present invention to provide a thread cutting knife device which enables the sewn cloth to have an excellent finish after completion of cutting.

It is a third object of the present invention to provide a thread cutting knife device capable of preventing the needle thread looping portion at the side of the cloth and the bobbin thread from being injured.

To achieve the above objects, the present invention comprises a sewing machine having a bed. A lower shaft is rotatably supported by the bed. A throat plate is mounted on the bed. A hook is attached to the lower shaft for cooperating with a needle which extends beyond the throat plate at the time of stitching operation. A thread cutting knife and a loop spreading plate are respectively disposed adjacent to the hook for crossing between the hook and the throat plate and cutting a needle thread looping portion at a cloth side and a bobbin thread after completion of a series of stitching operations. A thread cutting driving mechanism drives the thread cutting knife and the loop spreading plate. The thread cutting knife and the loop spreading plate are respectively rotatably relatively supported by the lower shaft and are disposed substantially in a circular arc about an axis of the lower shaft. The thread cutting knife has a blade at an upper edge of the tip end thereof. The loop spreading plate having a thread dividing portion protruding into a cloth side needle thread looping portion and the needle thread looping portion at the cloth side. A thread drawing portion is defined at one edge of a base of the dividing portion for holding the upper thread looping portion at the cloth side and the bobbin thread. A blade positioned at the side of the throat plate is opposed to and crosses the blade of the thread cutting knife. The thread dividing portion is positioned at the side of lower surface of the thread cutting knife and protrudes into the side of the thread cutting knife.

The above and other objects, features and advantages of the present invention will become more apparent from the following description taken in conjunction with the accompanying drawings.

DESCRIPTION OF THE PREFERRED EMBODIMENT

Figure 1:
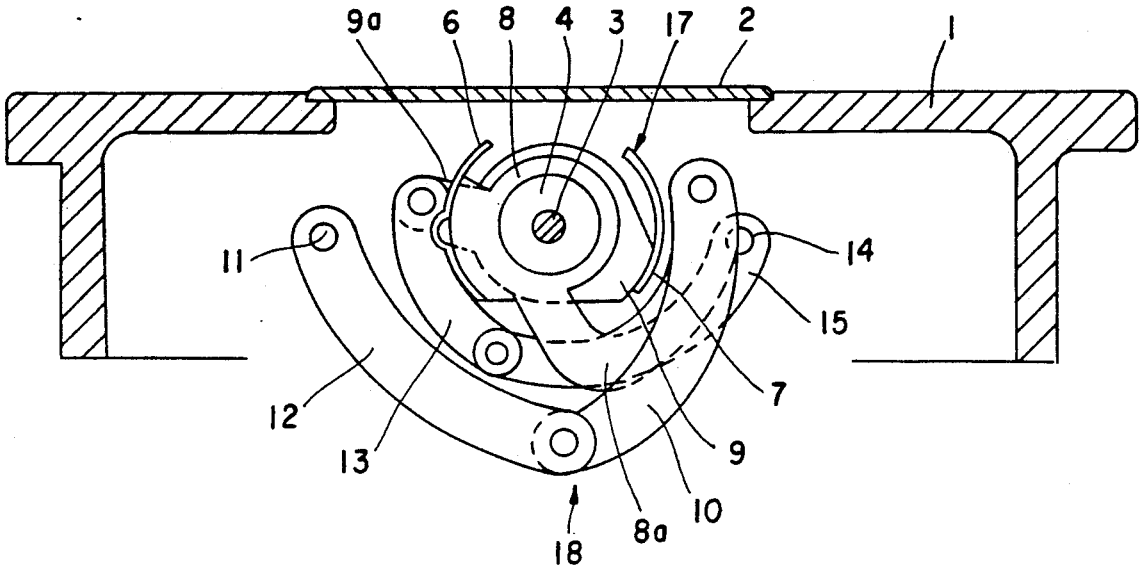
FIG. 1 is a partially cross sectional view of a thread cutting knife device of a sewing machine, wherein a hook is eliminated in accordance with a preferred embodiment of the present invention.

Referring now to FIGS. 1-5, a thread cutting knife device comprises a bed 1 of a sewing machine. A lower shaft 3 is rotatably supported by the bed 1. A throat plate 2 is mounted on the bed 1. A hook 5 is attached to the lower shaft 3 for cooperating with a needle which extends beyond the throat plate 2 at the time of stitching operation. A thread cutting knife 7 and a loop spreading plate 6 are respectively disposed adjacent to the hook 5 and are capable of crossing between the hook 5 and the throat plate 2 and cutting a needle thread looping portion NT1 at a cloth side and a bobbin thread BT after completion of a series of stitching operations. A thread cutting driving mechanism 18 drives the thread cutting knife 7 and the loop spreading plate 6, characterized in that the thread cutting knife 7 and the loop spreading plate 6 are respectively rotatably supported by the lower shaft 3 and are curved substantially in a circular arc about an axis of the lower shaft 3. The thread cutting knife 7 has a blade 7B at an upper edge of the tip end thereof. The loop spreading plate 6 has a thread dividing portion 6B extending into the needle thread looping portion NT1 at the cloth side and a thread looping portion NT2 at the side of the needle. A thread drawing portion 6C is formed at one edge of a base of the dividing portion 6B for holding the needle thread looping portion NT1 at the cloth side and the bobbin thread BT. A blade 6F is positioned at the side of the throat plate 2 and is opposed to and crosses the blade 7B of the thread cutting knife 7. The thread dividing portion 6B is positioned at the side of the lower surface of the thread cutting knife 7 and extends into the side of thread cutting knife 7.

The arrangement of the present invention will be described in more detail hereinafter.

Figure 3:
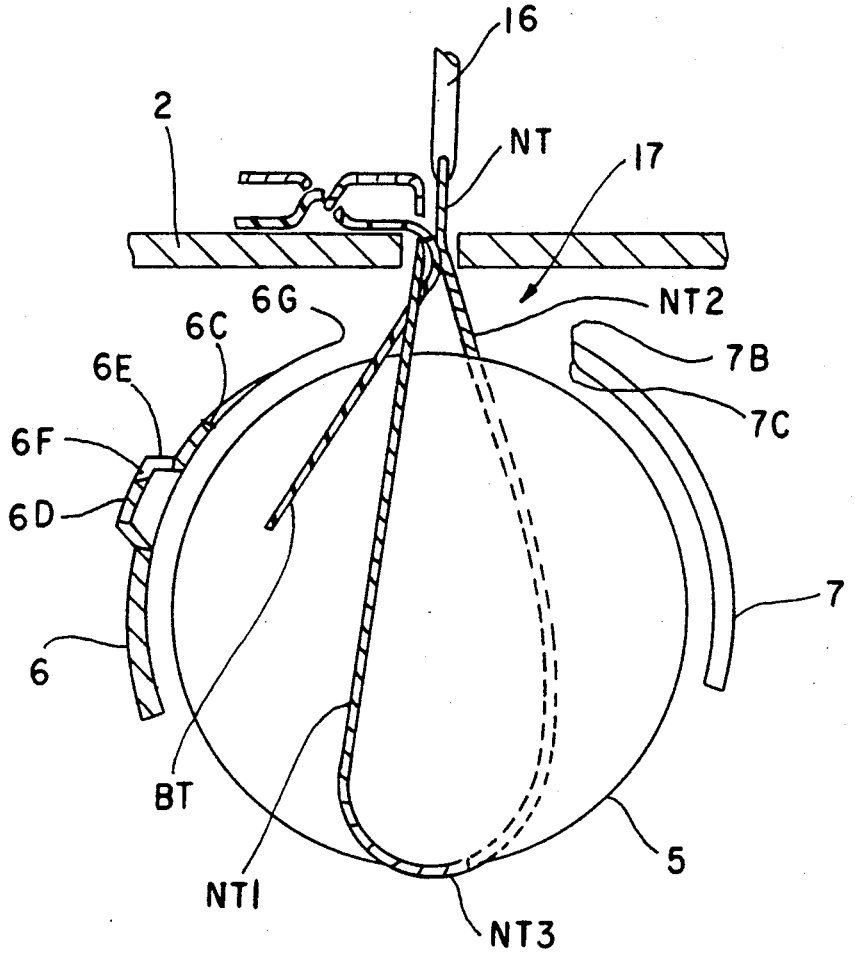
FIGS. 3, 4 and 5 are views showing arrangements of a loop spreading plate and a thread cutting knife in inoperative state.
Figure 4:
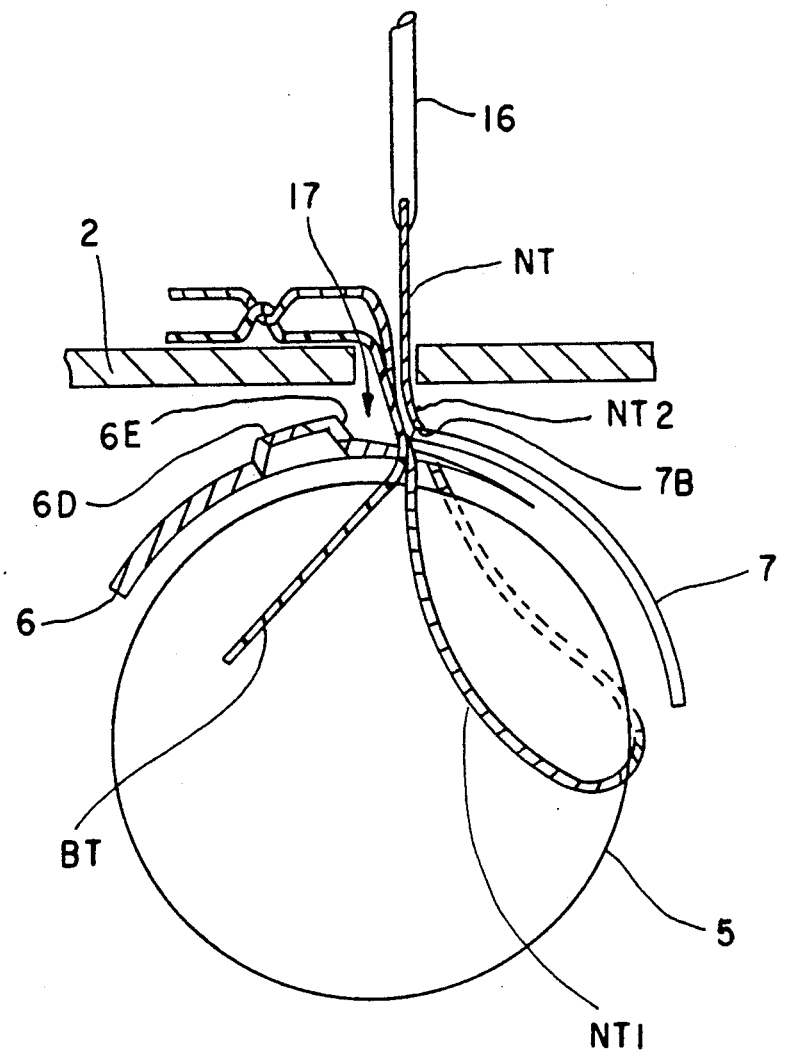

The lower shaft 3 is disposed on the throat plate 2 mounted right under the bed. The lower shaft 3 is rotatably supported on the bed 1 via a bearing 4. The shaft 3 is immovable in the axial direction and is interlocked with a main shaft (not shown) so that the lower shaft makes two turns while the main shaft makes one turn. The lower shaft 3 has a hook 5 at the tip end thereof as shown in FIGS. 3, 4 while the hook is supported by an arm (not shown) of the sewing machine on the bed 1 and cooperates with a needle 16 interlocked and vertically movable with the main shaft for forming a lock stitch.

Thread cutting knife 7 is mounted on the lower shaft 3. The thread cutting knife 7 has a circular arc shape disposed about the axis of the lower shaft 3 which is rotatably supported together with the loop spreading plate 6 on the lower shaft. The loop spreading plate 6 and the thread cutting knife 7 are disposed in opposite relation in inoperative state. The driving mechanism 18 drives the loop spreading plate 6 and the thread cutting knife 7. After completion of a series of stitches of the sewn cloth, the loop spreading plate 6 and the thread cutting knife 7 are rotatably driven by the driving mechanism 18 so that the loop spreading plate 6 and the thread cutting knife 7 are operated to cross in a space defined between the throat plate 2 and the hook 5 to cut off the stitching thread composed of the needle thread NT and the bobbin thread BT.

Figure 2:
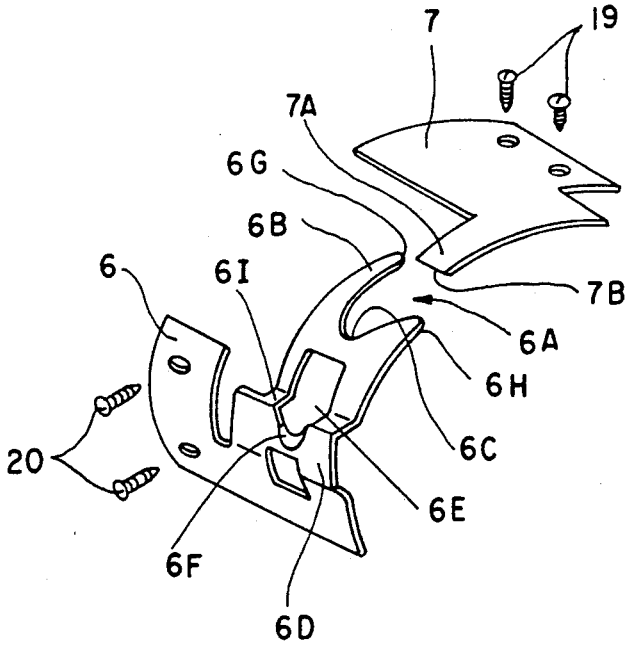
FIG. 2 is a perspective view showing a loop spreading plate and a thread cutting knife in inoperative state.

The thread cutting knife 7 is attached by a screw 19 as shown in FIG. 2 to an outer periphery of a cylindrical thread cutting knife attaching table 9 which is rotatably mounted on the outer periphery of the bearing. The loop spreading plate 6 is attached by a screw 20 as shown in FIG. 2 to an outer periphery of a cylindrical loop threading plate attaching table which is rotatably mounted on the outer periphery of the bearing 4.

The thread cutting knife attaching table 9 is radially connected at 9a to a thread cutting knife swing arm 15 integrally swingable with a thread cutting knife swing shaft 14 via a link 13. The loop spreading plate attaching table 8 has a radially extending portion 8a connected to a loop spreading plate swing arm 12 integrally swingably with the loop spreading plate swing shaft 11 via a link 12, forming the driving mechanism 18 which rotatably drives the loop spreading plate 6 and the thread cutting knife in opposite directions. The thread cutting knife swing shaft 14 and the loop spreading swing shaft 11 are respectively rotatably supported by the bed 1 and are rotatably driven in opposite directions around the lower shaft 3, for example, being rotatably driven by a cam unit upon the reception of the thread cutting signal to therby permit the loop spreading plate 6 and the thread cutting knife to cross in the space between the hook and the throat plate.

As shown in FIG. 2, the thread cutting knife 7 has a sharp blade 7B at the tip end upper edge of a projection 7A which extends circumferentially. The loop spreading plate 6 has one end 6A extending circumferentially from a loop spreading plate 6. Plate 6 is forked to form a dividing portion 6B and a guide portion 6H respectively extending circumferentially and a thread drawing portion 6C positioned at one edge of the base of the thread driving portion 6B, namely, at the valley of the thread dividing portion 6B and a guide portion 6H. The guide portion 6H is positioned right above the hook 5 but at the side of the hook 5 rather than the thread cutting knife 7, namely, at the lower portion and extends in the operative direction toward the thread cutting knife 7. The thread dividing portion 6B is wound on the hook 5 during the thread cutting operation whereby the thread dividing portion 6B enters between the needle thread looping portion NT1 at the side of the cloth of the needle thread NT positioned at one side of the hook 5, the bobbin thread BT and the needle thread looping portion NT2 at the side of the needle of the needle thread NT to separate thereof, whereby the needle thread looping portion NT1 at the side of the cloth and the bobbin thread BT are guided between 6H and 6B. As a result, the needle thread looping portion NT1 at the side of the cloth and the bobbin thread BT are introduced into the thread drawing portion 6C positioned at the needle thread looping portion NT1 at the side of the cloth and the bobbin thread BT are retained thereby. A stepped hill 6D of the circular arc shape protrudes radially outward and is formed at the base side rather than at the thread drawing portion 6C via the thread dividing portion 6B, the guide portion 6H and an inclined portion 6I. A blade 6F is formed at the lower edge of the stepped hill of the circumference of opening 6E. Hence, the blade 6F is positioned close to the side of the throat plate 2 rather than at the thread dividing portion 6B and cooperates with the blade 7B of the thread cutting knife 7 right under the throat plate 2 for cutting the needle thread looping portion NT1 at the side of the cloth and the bobbin thread BT.

The blade 7B of the projection 7A of the thread cutting knife 7 has a rounded chamfered corner 7C which is extended between the chamfered corner 7C of the thread cutting knife 7 and the thread drawing portion 6C of the loop spreading plate 6 during the thread cutting operation so that the needle thread looping portion NT1 at the side of the cloth and the bobbin thread BT which are largely bent are placed in smoothly sliding contact with the thread drawing portion 6C without being damaged thereby.

An operation thereof is described hereinafter.

Upon completion of the stitching operation of the one piece of the sewn cloth, the movement of needle 16 is stopped upon the reception of an electric signal issued by the control unit (not shown). A thread cutting signal is issued by the control unit when the needle 16 is moved to the upper stop position by the operation of the control unit. The loop spreading plate 6 and the thread cutting knife 7 cross under the throat plate 2 on which the sewn cloth is mounted to automatically cut off the needle thread looping portion NT1 at the side of the cloth and the bobbin thread BT.

FIG. 3 shows a position when the stitching operation is completed in which the needle 16 is moved from the lower stop position to the upper position while the needle thread NT is wound annularly on the hook 5 with rotation of the hook 5 so that the needle thread looping portion NT3 is expanded gradually to allow the loop spreading plate 6 and the thread cutting knife 7 to be in position immediately before the thread cutting operation takes place. Accompanied by the upward movement of the needle 16, the driving mechanism 18 is operated so that the loop spreading plate 6 starts to rotate clockwise about the axis of the lower shaft 3 as shown in FIG. 4. As a result, the thread drawing portion enters between the needle thread looping portion NT1 at the side of the cloth and the bobbin thread BT positioned at one side of the hook 5 and the needle thread looping portion NT2 at the side of the needle of the needle thread NT positioned at the other end of the hook 5, thus guiding the needle thread looping portion NT1 at the side of the cloth and the bobbin thread BT between the guide portion 6H and retaining them by the thread drawing portion 6C. Introduction of the needle thread looping portion NT1 at the side of the cloth and the bobbin thread BT to the thread drawing portion 6C is carried out in such manner that the needle thread looping portion NT1 at the side of the cloth and the bobbin thread BT are pushed at the tip end of the thread cutting knife 7. An appropriate tension is applied to the needle thread looping portion NT1 at the side of the cloth and the bobbin thread BT extended between the blade 7B of the thread cutting knife and the thread drawing portion 6C of the loop spreading plate 6 and is accompanied by close contact of the blade of the thread cutting knife 7 with the thread driving portion 6C of the loop spreading plate 6. As a result, a space of appropriate length is formed at the side of the hook 5 rather than at the blade 7B of the thread cutting knife 7, namely, at the side of the sewing machine. Consequently, inasmuch as the blade 7B of the thread cutting knife 7 formed on the tip end upper edge of the projection 7A, the needle thread looping portion NT1 at the side of the cloth and the bobbin thread BT which extend between the blade 7B of the thread cutting knife 7 and the thread drawing portion 6C of the loop spreading plate 6 are prevented from being damaged by the blade 7B of the thread cutting knife 7. Furthermore, the lower edge corner portion of the blade 7B of the thread cutting knife 7 forms the rounded chamfered corner 7C. The chamfered corner 7C and the needle thread looping portion NT1 largely bent at the side of the cloth and the bobbin thread BT contact with each other in sliding relation so that the needle thread looping portion NT1 at the side of the cloth and the bobbin thread BT will not be damaged. However, it is desirable to prevent the damage caused by the friction between the needle thread looping portion NT1 at the side of the cloth and the bobbin thread BT while the loop spreading plate 6 and the thread cutting knife 7 effect the relative rotation while establishing enough space to receive the needle thread NT and the bobbin thread BT between the lower surface of the projection 7A of the thread cutting knife 7 and the upper surface of one end 6A of the loop spreading plate 6.

Figure 5:
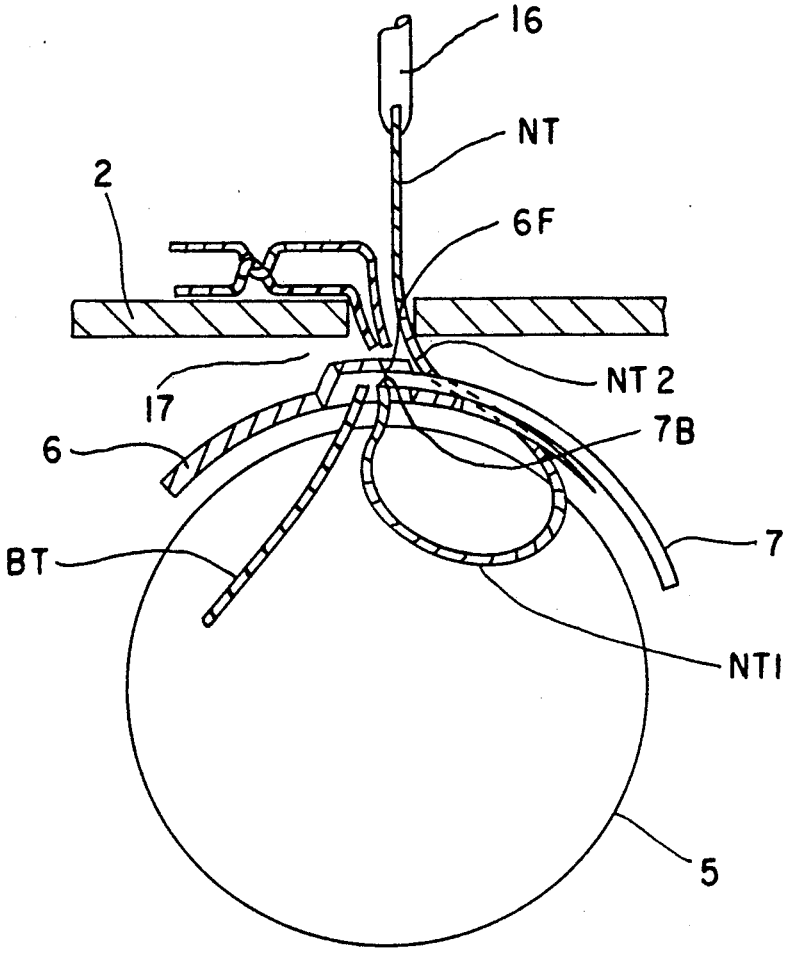

The blade 7B of the thread cutting knife 7 enters into an opening of the loop spreading plate 6 accompanied by the needle thread looping portion NT1 at the side of the cloth and the bobbin thread BT as shown in FIG. 5. The blade 6F of the loop spreading plate 6 crosses the blade 7B of the thread cutting knife 7 to cut off the needle thread looping portion NT1 at the side of the cloth and the bobbin thread BT at the portion right under the throat plate 2.

After completion of cutting off the needle thread looping portion NT1 at the side of the cloth and the bobbin thread BT, the loop spreading plate 6 rotates counterclokwise about the axis of the lower shaft 3 with the operation opposite to the thread cutting operation by the driving mechanism 18 while the thread cutting knife 7 rotates clockwise about the axial line of the lower shaft 3 and returns to the original position.

The thread cutting knife device described above has the following advantages.

Firstly, inasmuch as the dividing portion of the loop spreading plate 6 is formed in a position adjacent to the hook rather than the thread cutting knife, the dividing portion must enter into a relatively larger space between the needle thread looping portion at the side of the cloth and the bobbin thread, distinctly separating them.

Secondly, inasmuch as the needle thread at the side of the cloth and the bobbin thread are cut off by the blade of the loop spreading plate 6 and the blade of the thread cutting knife, the finishing of the cutting off portion is superior, eliminating any subsequent manual correction operation. Since the blade of the loop spreading plate is positioned close to the throat plate rather than the dividing portion, the thread ends of the needle thread and the bobbin thread remaining on the side of the sewn cloth after completion of the cutting operation can be shortened as compared with the prior art.

Thirdly, inasmuch as a space is formed between the blade of the thread cutting knife and the thread drawing portion of the loop spreading plate, and the blade of the thread cutting knife is formed at the tip end upper edge thereof, the portion close to the needle thread at the side of the cloth and the bobbin thread cut off by the thread cutting knife does not contact in intense sliding relation with the blade of the thread cutting knife until the thread cutting operation takes place, thus preventing the needle thread at the side of the cloth and the bobbin thread from being damaged. In addition, inasmuch as the large bent portion of the needle thread looping portion at the side of the cloth and the bobbin thread are in sliding contact with the chamfered corner, the cut off portion also will not be damaged.

Although the invention has been described in its preferred form with a certain degree of particularity, it is to be understood that many variations and changes are possible in the invention without departing from the scope thereof.

What is claimed is:

1. A thread cutting knife device in a sewing machine having a bed and comprising:

a lower shaft rotatably supported at the bed and having an axis;

a throat plate mounted on the bed;

a hook attached to the lower shaft for cooperating with a needle extending beyond the throat plate at a time of a stitching operation, the hook being spaced from the throat plate;

a thread cutting knife defining a portion of a circular arc centered on the axis and rotatably disposed on the shaft, the knife having a tip with a cutting blade formed thereon, the knife being disposed in a space between the hook and the throat plate;

a loop spreading plate defining another portion of a circular arc and rotatably disposed on the shaft, the loop spreading plate being disposed in the space between the hook and the throat plate, the loop spreading plate having a fork disposed adjacent the tip, the fork having a valley, the valley and the cutting blade being spaced apart except during a cutting operation; and driving means for rotating the knife and the loop spreading plate in opposite directions during a cutting operation to cause the cutting blade to engage the valley.

2. The device of claim 1 further including a first cylindrical table rotatably disposed about the shaft and secured to the knife and a second cylindrical table secured to the loop spreading plate.

* * * * *